US011089404B2

(12) United States Patent
Miyamoto et al.

(10) Patent No.: US 11,089,404 B2
(45) Date of Patent: Aug. 10, 2021

(54) SOUND PROCESSING APPARATUS AND SOUND PROCESSING METHOD

(71) Applicant: PANASONIC INTELLECTUAL PROPERTY MANAGEMENT CO., LTD., Osaka (JP)

(72) Inventors: Masanari Miyamoto, Fukuoka (JP); Hiromasa Ohashi, Osaka (JP); Naoya Tanaka, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/751,857

(22) Filed: Jan. 24, 2020

(65) Prior Publication Data

US 2020/0245066 A1 Jul. 30, 2020

(30) Foreign Application Priority Data

Jan. 29, 2019 (JP) ..... JP2019-013446

(51) Int. Cl.
*H04R 3/00* (2006.01)
*G10L 25/78* (2013.01)
(Continued)

(52) U.S. Cl.
CPC ..... *H04R 3/14* (2013.01); *G10L 25/51* (2013.01); *G10L 25/78* (2013.01); *H04R 1/403* (2013.01); *H04R 1/406* (2013.01); *H04R 3/005* (2013.01)

(58) Field of Classification Search
None
See application file for complete search history.

(56) References Cited

U.S. PATENT DOCUMENTS 6,449,361 B1 9/2002 Okuda
7,440,891 B1 * 10/2008 Shozakai ..... G10L 15/20 704/233
(Continued)

FOREIGN PATENT DOCUMENTS

JP 11-289282 10/1999
JP 2005-536128 11/2005
(Continued)

OTHER PUBLICATIONS

Office Action (Notification of Reason for Refusal) issued in Japanese Counterpart Patent Appl. No. 2019-13446, dated Sep. 17, 2019, along with an English translation thereof.
(Continued)

*Primary Examiner* — Ping Lee
(74) *Attorney, Agent, or Firm* — Greenblum & Bernstein, P.L.C.

(57) ABSTRACT

A sound processing apparatus includes n number of microphones that are disposed correspondingly to n number of persons and that mainly collect sound signals uttered by respective relevant persons, a filter that suppresses crosstalk components included in a talker sound signal collected by a microphone corresponding to at least one talker using the sound signals collected by the n number of microphones, a parameter updater that updates a parameter of the filter for suppressing the crosstalk components and stores an update result in the memory in a case where a predetermined condition including time at which at least one talker talks is satisfied, and a sound output controller that outputs the sound signals, acquired by subtracting the crosstalk components by the filter from the talker sound signals based on the update result, from a speaker.

13 Claims, 11 Drawing Sheets

Tb2

| TALKER SITUATION | FILTER UPDATE | CROSSTALK SUPPRESSION PROCESS | | EQUATION |
|---|---|---|---|---|
| | | m1 | m2 | |
| NON-EXIST | × | × | × | y1 = m1<br>y2 = m2 |
| h1 | h1 ⇒ m2 | × | ○ | y1 = m1<br>y2 = m2 − w12 * m1 |
| h2 | h2 ⇒ m1 | ○ | × | y1 = m1 − w21 * m2<br>y2 = m2 |
| h1 + h2 | × | ○ | ○ | y1 = m1 − w21 * m2<br>y2 = m2 − w12 * m1 |

(51) Int. Cl.

| | |
|---|---|
| ***H04R 3/14*** | (2006.01) |
| ***H04R 1/40*** | (2006.01) |
| ***G10L 25/51*** | (2013.01) |

(56) References Cited

U.S. PATENT DOCUMENTS

| | | | | |
|---|---|---|---|---|
| 2004/0071284 | A1 | 4/2004 | Abutalebi et al. | |
| 2011/0058667 | A1 | 3/2011 | Takada | |
| 2016/0261951 | A1* | 9/2016 | Matheja | H03G 3/301 |
| 2017/0110123 | A1 | 4/2017 | Sharifi et al. | |
| 2017/0110130 | A1 | 4/2017 | Sharifi et al. | |
| 2017/0110144 | A1 | 4/2017 | Sharifi et al. | |
| 2018/0158467 | A1 | 6/2018 | Suzuki et al. | |
| 2018/0254045 | A1 | 9/2018 | Sharifi et al. | |
| 2018/0332174 | A1 | 11/2018 | Kawai et al. | |
| 2019/0287536 | A1 | 9/2019 | Sharifi et al. | |

FOREIGN PATENT DOCUMENTS

| | | |
|---|---|---|
| JP | 2009-021859 | 1/2009 |
| JP | 2011-061449 | 3/2011 |
| JP | 2017-076117 | 4/2017 |
| WO | 2017/064840 | 4/2017 |
| WO | 2017/154960 | 9/2017 |

OTHER PUBLICATIONS

Office Action (Decision to Grant a Patent) issued in Japanese Counterpart Patent Appl. No. 2019-13446, dated Nov. 12, 2019, along with an English translation thereof.

* cited by examiner

FIG.8

Tb1

| TALKER SITUATION | FILTER UPDATE | CROSSTALK SUPPRESSION PROCESS | | EQUATION |
|---|---|---|---|---|
| | | m1 | m2 | |
| NON-EXIST | × | ○ | ○ | $y1 = m1 - w21 * m2$<br>$y2 = m2 - w12 * m1$ |
| h1 | h1 ⇒ m2 | ○ | ○ | $y1 = m1 - w21 * m2$<br>$y2 = m2 - w12 * m1$ |
| h2 | h2 ⇒ m1 | ○ | ○ | $y1 = m1 - w21 * m2$<br>$y2 = m2 - w12 * m1$ |
| h1 + h2 | × | ○ | ○ | $y1 = m1 - w21 * m2$<br>$y2 = m2 - w12 * m1$ |

FIG.10

Tb2

| TALKER SITUATION | FILTER UPDATE | CROSSTALK SUPPRESSION PROCESS | | EQUATION |
|---|---|---|---|---|
| | | m1 | m2 | |
| NON-EXIST | × | × | × | y1 = m1<br>y2 = m2 |
| h1 | h1 ⇒ m2 | × | ○ | y1 = m1<br>y2 = m2 − w12 * m1 |
| h2 | h2 ⇒ m1 | ○ | × | y1 = m1 − w21 * m2<br>y2 = m2 |
| h1 + h2 | × | ○ | ○ | y1 = m1 − w21 * m2<br>y2 = m2 − w12 * m1 |

FIG.12

Tb3

| TALKER SITUATION | FILTER UPDATE | CROSSTALK SUPPRESSION PROCESS | | EQUATION |
|---|---|---|---|---|
| | | m1 | m2 | |
| NON-EXIST | × | × | × | y1 = m1<br>y2 = m2 |
| h1(A) | h1 ⇒ m2 | ○ | ○ | y1 = m1 − w21A*m2<br>y2 = m2 − w12A*m1 |
| h2(B) | h2 ⇒ m1 | ○ | ○ | y1 = m1 − w21B*m2<br>y2 = m2 − w12B*m1 |
| h1 + h2 (C) | h1 ⇒ m2<br>h2 ⇒ m1 | ○ | ○ | y1 = m1 − w21C*m2<br>y2 = m2 − w12C*m1 |

SOUND PROCESSING APPARATUS AND SOUND PROCESSING METHOD

CROSS REFERENCE TO RELATED APPLICATIONS

This application is based upon and claims the benefit of priority of Japanese Patent Application No. 2019-13446 filed on Jan. 29, 2019, the contents of which are incorporated herein by reference in its entirety.

BACKGROUND OF THE INVENTION

1. Field of the Invention

The present disclosure relates to a sound processing apparatus and a sound processing method.

2. Description of the Related Art

For example, in a relatively large vehicle, such as a minivan, a wagon, or a one box car, in which a plurality of (for example, two or more columns) seats are disposed in a longitudinal direction of a vehicle body, it is considered to mount a sound technology for performing a conversation between a driver who sits on a driver's seat and a passenger (for example, a family member or a friend of the driver) who sits on a rear seat, playing music of a car audio up to the part seat, or transferring or inputting/outputting sounds between passengers or onboard equipment using microphones and speakers installed in respective seats.

In addition, in recent years, a large number of vehicles which include communication interfaces is released. The communication interface has a wireless communication function and is constructed by, for example, a mobile phone network (cellular network), a wireless Local Area Network (LAN), or the like, and thus a network environment is also established in the vehicles. The driver or the like accesses, for example, a cloud computing system (hereinafter, simply referred to as "cloud") on an Internet line through the communication interface, and thus it is possible to receive various services in driving.

Here, development in an automatic sound recognition system is accelerated as one of sound technologies using the cloud in household appliances. The automatic sound recognition system is spread as a human machine interface which receives the services on the cloud. The automatic sound recognition system converts sounds uttered by a human into text data or the like, and causes a control apparatus, such as a computer, to recognize content of the sounds. The automatic sound recognition system is an interface which replaces keyboard input using human fingers, and is capable of instructing the computer or the like with an operation which is further near to the human. Specifically, in the vehicle, fingers of the driver are taken for steering a wheel in driving based on the driver according to the related art or, for example, in automatic driving at an automatic driving level 3, and thus there is an inevitable motive to introduce a sound technology for automatic sound recognition with respect to the vehicle.

The automatic driving level is classified into no driving automation (level 0), driver assistance (level 1), partial driving automation (level 2), conditional driving automation (level 3), high driving automation (level 4), and full driving automation (level 5) according to National Highway Traffic Safety Administration (NHTSA). At the level 3, an automatic driving system leads the driving and driving by a human is requested if necessary. The level 3 of the automatic driving system is put into practical use in recent years.

As the sound technology for the automatic sound recognition according to the related art, a technology (for example, refer to JP-A-2017-76117, Patent Literature 1) is known for determining whether or not uttered audio data (sound signal) corresponds to a hot word, generating a hot word audio fingerprint of the audio data which is determined to correspond to the hot word, and cancelling access to an uttered computer device in a case where the hot word audio fingerprint coincides with a previously stored hot word audio fingerprint.

Patent Literature 1: JP-A-2017-76117

SUMMARY OF THE INVENTION

However, in a configuration of JP-A-2017-76117, in a case where different microphones are disposed to correspond to respective seats in a vehicle body, there is a possibility that a voice, which is uttered by another surrounding passenger, is also collected as a sound to a microphone for a talker, which is disposed in a location separated at an approximately regular distance from a mouth of each talker. The voice, which is uttered by another passenger, is a so-called crosstalk component, and is an extra sound signal which highly likely deteriorates a sound quality of a sound primarily collected by the microphone for the talker. Accordingly, the sound quality of the sound collected by each microphone for the talker is deteriorated due to the crosstalk component, and thus there is a problem in that a performance of recognition of the sound uttered by the talker is deteriorated.

The present disclosure is proposed in consideration of the above-described situation according to the related art, and a non-limited object of the present disclosure is to provide a sound processing apparatus and a sound processing method, which alleviate influence of the crosstalk component based on the sound uttered by another surrounding person, and which suppress deterioration in the sound quality of the sound uttered by the talker and collected by a relevant microphone under an environment in which different microphones are disposed to correspond to respective persons.

An aspect of the present disclosure provides a sound processing apparatus including: a sound output controller that at least includes a filter, configured to suppress respective crosstalk components generated due to an utterance of another talker, the crosstalk components being included in respective talker sound signals collected by n number of microphones disposed correspondingly to n number of persons in one enclosed space, where n is an integer which is equal to or larger than 2, and a parameter updater, configured to update a parameter of the filter for suppressing the crosstalk components and to store an update result in a memory; and a talker situation detector, configured to detect an utterance situation of each of the persons, to which the n number of microphones correspond, in the enclosed space by using the respective talker sound signals collected by the n number of microphones, wherein the parameter updater updates the parameter of the filter for suppressing the crosstalk components and stores the update result in the memory, in a case where the talker situation detector determines that a predetermined condition including time at which at least one talker talks is satisfied, and wherein the sound output controller receives the respective talker sound signals collected by the n number of microphones, and outputs any of sound signals, which are acquired by suppressing the crosstalk components of the talker sound signals by the filter for the respective received talker sound signals, or the received talker sound signals, based on the utterance situation in the enclosed space, which is detected by the talker situation detector.

Another aspect of the present disclosure provides a sound processing method including: suppressing respective crosstalk components generated due to an utterance of another talker, the crosstalk components being included in respective talker sound signals collected by n number of microphones disposed correspondingly to n number of persons in one enclosed space, where n is an integer which is equal to or larger than 2; detecting utterance situations of the respective persons, to which the n number of microphones correspond, in the enclosed space using the respective talker sound signals collected by the n number of microphones; updating the parameter of the filter for suppressing the crosstalk components and storing an update result in a memory, in a case where it is determined that a predetermined condition including time at which at least one talker talks is satisfied; and outputting any of sound signals, which are acquired by suppressing the crosstalk components of the talker sound signals by the filter for the respective received talker sound signals, or the received talker sound signals, based on the detected utterance situation.

According to the present disclosure, it is possible to alleviate influence of a crosstalk component based on a sound uttered by another surrounding person, and to suppress deterioration in a sound quality of a sound that is uttered by a talker and is collected by a relevant microphone under an environment in which different microphones are disposed to correspond to respective persons.

BRIEF DESCRIPTION OF THE DRAWINGS

In the accompanying drawings:

FIG. 8 is a diagram illustrating an example of registration content of a setting table according to a first embodiment;

FIG. 10 is a diagram illustrating an example of registration content of a setting table according to a modified example of the first embodiment;

FIG. 12 is a diagram illustrating an example of registration content of a setting table according to the second embodiment.

DETAILED DESCRIPTION OF THE EXEMPLARY EMBODIMENTS

In order to effectively support conversation on an inside of a vehicle, for example, in a luxury vehicle, microphones are disposed at respective seats on which respective passengers sit down. A sound processing apparatus, which is mounted on the luxury vehicle, forms directivity of a sound using the sound collected by each microphone, thereby emphasizing a voice spoken by a talker (a talker who primarily wants to talk) who is a passenger facing the microphone. Therefore, in a case of an environment in which a characteristic of transfer of the sound to the microphone is ideal on the inside of the vehicle, a listener (that is, an audience) easily listens to the voice spoken by the talker. Since the inside of the vehicle is a narrow space, the microphone is easily influenced by a reflected sound. In addition, due to a slight environmental change on the inside of the vehicle which is moving, the characteristic of the transfer of the sound is changed to some extent from the ideal environment as a practical matter. Therefore, it is not possible to sufficiently suppress crosstalk components generated due to a voice spoken by another talker who is not the above-described talker who primarily wants to talk, which are included in a sound signal of an utterance collected by the microphone, and thus there is a case where the sound quality of the voice spoken by the talker who primarily wants to talk is deteriorated. In addition, the microphone, which is used to form the directivity of the sound, is expensive.

Here, in embodiments below, examples of a sound processing apparatus and a sound processing method, which are capable of sufficiently suppressing the crosstalk components based on an utterance of another talker who is not the talker who primarily wants to talk, using an inexpensive microphone will be described.

Hereinafter, embodiments, which specifically disclose configurations and actions of the sound processing apparatus and the sound processing method according to the present disclosure, will be described in detail with reference to the accompanying drawings. There is a case where unnecessarily detailed description is omitted. For example, there is a case where detailed description of already well-known matters or repeated description with respect to a substantially identical configuration is omitted. The reason for this is to avoid unnecessary redundancy of description below, and to make easy understanding of those skilled in the art. The accompanying drawings and the description below are provided for those skilled in the art to sufficiently understand the present disclosure, and are not intended to limit subjects in the claims.

First Embodiment

Figure 1:
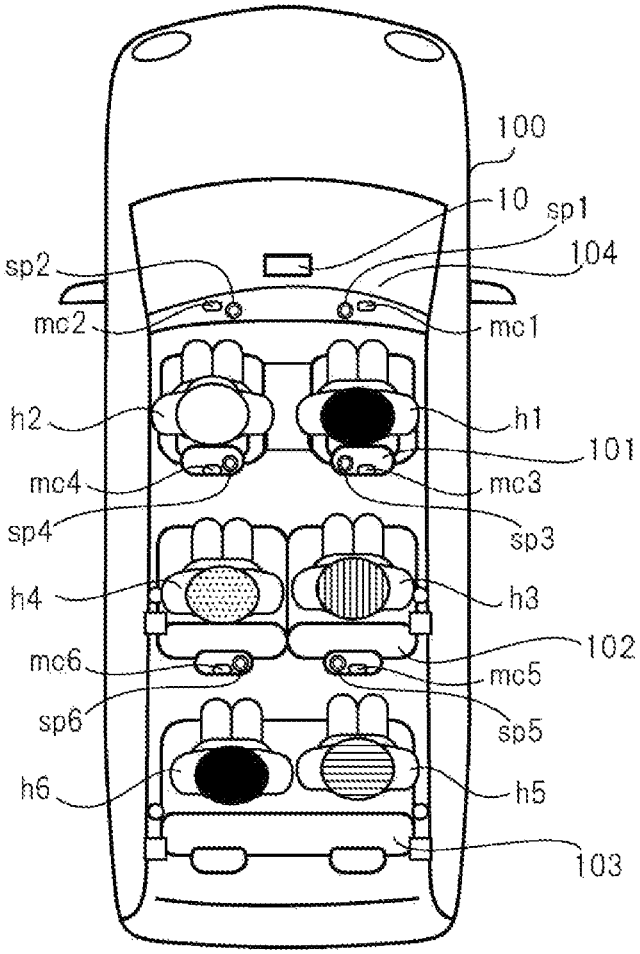
FIG. 1 is a plan view illustrating an inside of a vehicle on which a sound processing system according to a first embodiment is mounted.

FIG. 1 is a plan view illustrating an inside of a vehicle 100 on which a sound processing system 5 according to a first embodiment is mounted. The sound processing system 5 collects sounds using onboard microphones and outputs the sounds from onboard speakers such that a smooth conversation is possible between a driver who sits on a driver's seat and a passenger who sits on each of middle seat and rear seat. In the description below, the passenger may include the driver.

As an example, the vehicle 100 is a minivan. On the inside of the vehicle 100, three rows of seats 101, 102, and 103 are disposed in a front-back direction (in other words, a straight forward direction of the vehicle 100). Here, two passengers for each of the seats 101, 102, and 103, total six passengers including the driver go on board. On a front surface of an instrument panel 104 on the inside of the vehicle, a microphone mc1, which mainly collects a voice spoken by a passenger h1 who is the driver, and a microphone mc2, which mainly collects a voice spoken by a passenger h2 who sits on a passenger seat, are disposed. In addition, at a backrest part (including a headrest) of the seat 101, microphones mc3 and mc4, which mainly collect voices spoken by passengers h3 and h4, respectively, are disposed. In addition, at a backrest part (including a headrest) of the seat 102, microphones mc5 and mc6, which mainly collect voices spoken by passengers h5 and h6, respectively, are disposed. In addition, in vicinities of the respective microphones mc1, mc2, mc3, mc4, mc5, and mc6 on the inside of the vehicle 100, speakers sp1, sp2, sp3, sp4, sp5, and sp6 are respectively disposed to form pairs with the respective microphones. On the inside of the instrument panel 104, a sound processing apparatus 10 is disposed correspondingly to each of n (n: an integer which is equal to or larger than two) number of persons (passengers). A disposition place of the sound processing apparatus 10 is not limited to a location (that is, an inside of the instrument panel 104) illustrated in FIG. 1.

In the embodiment below, an example is assumed that a voice, which is spoken by a talker (for example, the driver or the passenger other than the driver) in the narrow space, such as the narrow inside of the vehicle, is collected by a microphone, which is dedicated to each passenger and which is disposed before the talker, and sound recognition is performed on the sound. In the microphone, which is dedicated to each passenger, a sound, such as a voice uttered by another passenger who exists in a location far from a mouth of the talker and a surrounding noise, is also collected. The sound becomes a crosstalk component which deteriorates a sound quality of the sound with respect to the voice spoken by the talker. In a case where the crosstalk component exists, a quality (sound quality) of the sound collected by the microphone is deteriorated, and a performance of the sound recognition is lowered. The sound processing system 5 suppresses the crosstalk component, which is included in a sound signal collected by the microphone corresponding to the talker, thereby improving the quality of the voice spoken by the talker and improving the performance of the sound recognition.

Figure 2:
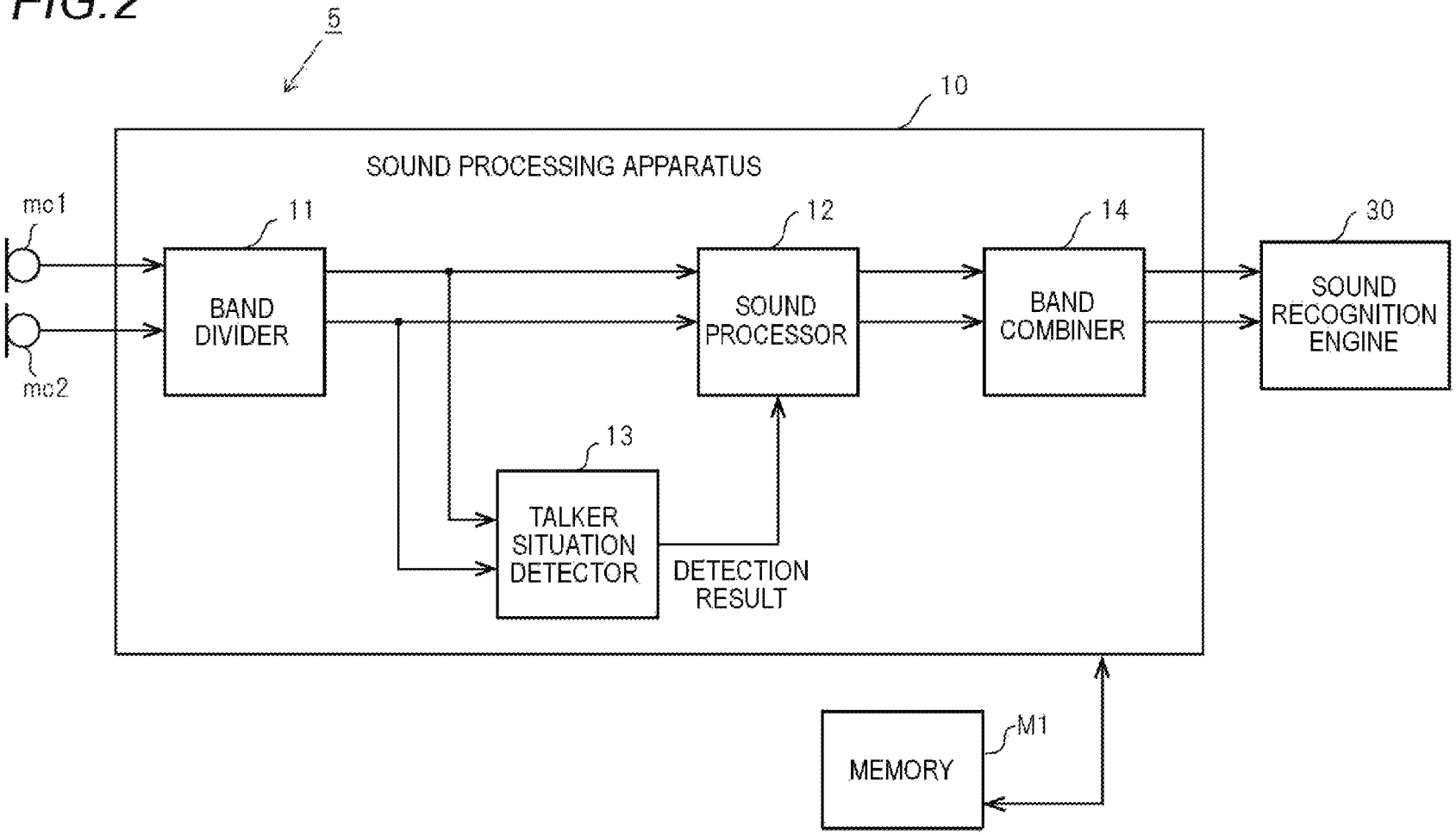
FIG. 2 is a block diagram illustrating an example of an inner configuration of the sound processing system.

Subsequently, an inner configuration of the sound processing system 5 according to the first embodiment will be described with reference to FIG. 2. For easy understanding of the description below, a use case in which two persons (for example, the driver and the passenger on the passenger seat) go on board in the vehicle 100 is illustrated and description is performed while assuming that the number of microphones disposed in the vehicle 100 is two. However, the number of disposed microphones is not limited two and may be equal to or larger than three, as illustrated in FIG. 1. FIG. 2 is a block diagram illustrating an example of the inner configuration of the sound processing system 5. The sound processing system 5 includes the two microphones mc1 and mc2, the sound processing apparatus 10, a memory M1, and a sound recognition engine 30. The memory M1 may be provided in the sound processing apparatus 10.

The microphone mc1 is a driver-dedicated microphone which is disposed in the instrument panel 104 before the driver's seat and which collects voices spoken by the passenger h1 who is the driver. It is possible to mention a sound signal based on an utterance, which is collected by the microphone mc1, of the passenger h1 who is the driver, as a talker sound signal.

The microphone mc2 is a microphone dedicated to a passenger at the passenger seat, the microphone mc2 being disposed in the instrument panel 104 before the passenger seat and mainly collecting a voice spoken by the passenger h2 at the passenger seat. It is possible to mention a sound signal based on the utterance, which is collected by the microphone mc2, of the passenger h2 as the talker sound signal.

The microphones mc1 and mc2 may be any of the directivity microphone and an omnidirectional microphone. Here, although the microphone mc1 of the driver and the microphone mc2 of the passenger at the passenger seat are illustrated as examples of the two microphones illustrated in FIG. 2, the microphones mc3 and mc4 dedicated to the passengers at the middle seat or the microphones mc5 and mc6 dedicated to the passengers at the rear seat may be used.

The sound processing apparatus 10 outputs sounds by suppressing the crosstalk components included in the sounds collected by the microphones mc1 and mc2. The sound processing apparatus 10 includes, for example, a processor, such as a Digital Signal Processor (DSP), and a memory. The sound processing apparatus 10 includes a band divider 11, a sound processor 12, a talker situation detector 13, and a band combiner 14 as functions realized by execution of the processor.

The band divider 11 performs division on the sound signal for each fixed predetermined band. In the embodiment, for example, the division is performed on the sound signal for each band of 500 Hz to provide, for example, 0 to 500 Hz, 500 Hz to 1 kHz, 1 kHz to 1.5 kHz . . . . In a case of the narrow space such as the inside of the vehicle, crosstalk easily occurs in the sound collected by the microphone due to reflection of the sound from a ceiling surface or a side surface of the inside of the vehicle, and thus the sound processing apparatus 10 is easily influenced by the crosstalk in a case of performing a sound process. For example, there is a case where, in the sound uttered by the talker, a sound, of which a specific band is emphasized, is collected by a microphone, which is not relevant to the talker, in the two microphones. In this case, the band division is not performed. Therefore, even in a case where sound pressures of the two microphones are compared, a sound pressure difference does not occur, and thus it is not possible to perform a process of suppressing the sound of the microphone which is not relevant to the talker. However, in a case where the band divider 11 performs the band division, the sound pressure difference occurs at a part other than the sound of which the specific band is emphasized. Therefore, it is possible for the sound processor 12 performs the process of suppressing the sound of the microphone which is not relevant to the talker.

The sound processor 12 includes an adaptive filter 20 (refer to FIG. 3) for suppressing a sound of other than the talker by performing a crosstalk component reduction process in a case where the sound of other than the talker (for example, a sound uttered by another talker) is input to a microphone dedicated to the talker as the crosstalk component. In a case where an utterance (hereinafter, referred to as "single talk") substantially performed by, for example, one talker is detected, the sound processor 12 learns the adaptive filter 20 so as to reduce the sound corresponding to the crosstalk component, and updates a filter coefficient of the adaptive filter 20 as a result of learning. As being disclosed in the above-described JP-A-2017-76117 or JP-A-2007-

19595, it is possible for the adaptive filter 20 to vary a filter characteristic by controlling the number of taps or a tap coefficient of a Finite Impulse Response (FIR) filter.

The talker situation detector 13 as an example of a single talk detector detects a talker situation (for example, the above-described single talk section) in which the driver or the passenger is talking on the inside of the vehicle. The talker situation detector 13 notifies a detection result of the talker situation (for example, the single talk section) to the sound processor 12. The talker situation is not limited to the single talk section, and may include a non-utterance section in which nobody talks. In addition, the talker situation detector 13 may detect a section (double talk section) in which two talkers are simultaneously talking.

The band combiner 14 combines sound signals, from which the crosstalk components are suppressed by the sound processor 12, in respective sound ranges acquired through division, thereby composing the sound signals acquired after the crosstalk components are suppressed. The band combiner 14 outputs the combined sound signals to the sound recognition engine 30.

The memory M1 includes, for example, a Random Access Memory (RAM) and a Read Only Memory (ROM), and temporarily stores a program, which is necessary to perform an operation of the sound processing apparatus 10, and data or information which is generated by a processor of the sound processing apparatus 10 during the operation. The RAM is, for example, a work memory used in a case where the processor of the sound processing apparatus 10 operates. The ROM previously stores the program and the data for controlling, for example, the processor of the sound processing apparatus 10. In addition, the memory M1 preserves the filter coefficient of the adaptive filter 20 associated with each of the microphones (in other words, a person whose sound signal is mainly collected in association with the microphone) disposed in the vehicle 100. The person whose sound signal is mainly collected in association with the microphone is, for example, a passenger who sits on a seat facing the microphone.

The sound recognition engine 30 recognizes sounds, which are collected by the microphones mc1 and mc2 and on which a process of suppressing the crosstalk component is performed by the sound processor 12, and outputs a sound recognition result. In a case where the speakers sp1, sp2, sp3, sp4, sp5, and sp6 are connected to the sound recognition engine 30, any of the speakers sp1, sp2, sp3, sp4, sp5, and sp6 outputs a sound, on which the sound recognition is performed, as the sound recognition result acquired by the sound recognition engine 30. For example, the sound recognition result corresponding to the sound, which is mainly collected in the microphone mc1 and is based on an utterance of the driver, is output from the speaker sp1 through the sound recognition engine 30. Each of the speakers sp1, sp2, sp3, sp4, sp5, and sp6 may be any of a directivity speaker and an omnidirectional speaker. In addition, an output of the sound recognition engine 30 may be used for a system for a TV conference performed while including a vehicle interior, support of a conversation in the vehicle, and captions (telop) of an onboard TV, and the like. In addition, the sound recognition engine 30 may be a vehicle onboard apparatus, or may be a cloud server (not illustrated in the drawing) which is connected from the sound processing apparatus 10 through a wide area network (not illustrated in the drawing).

Figure 3:
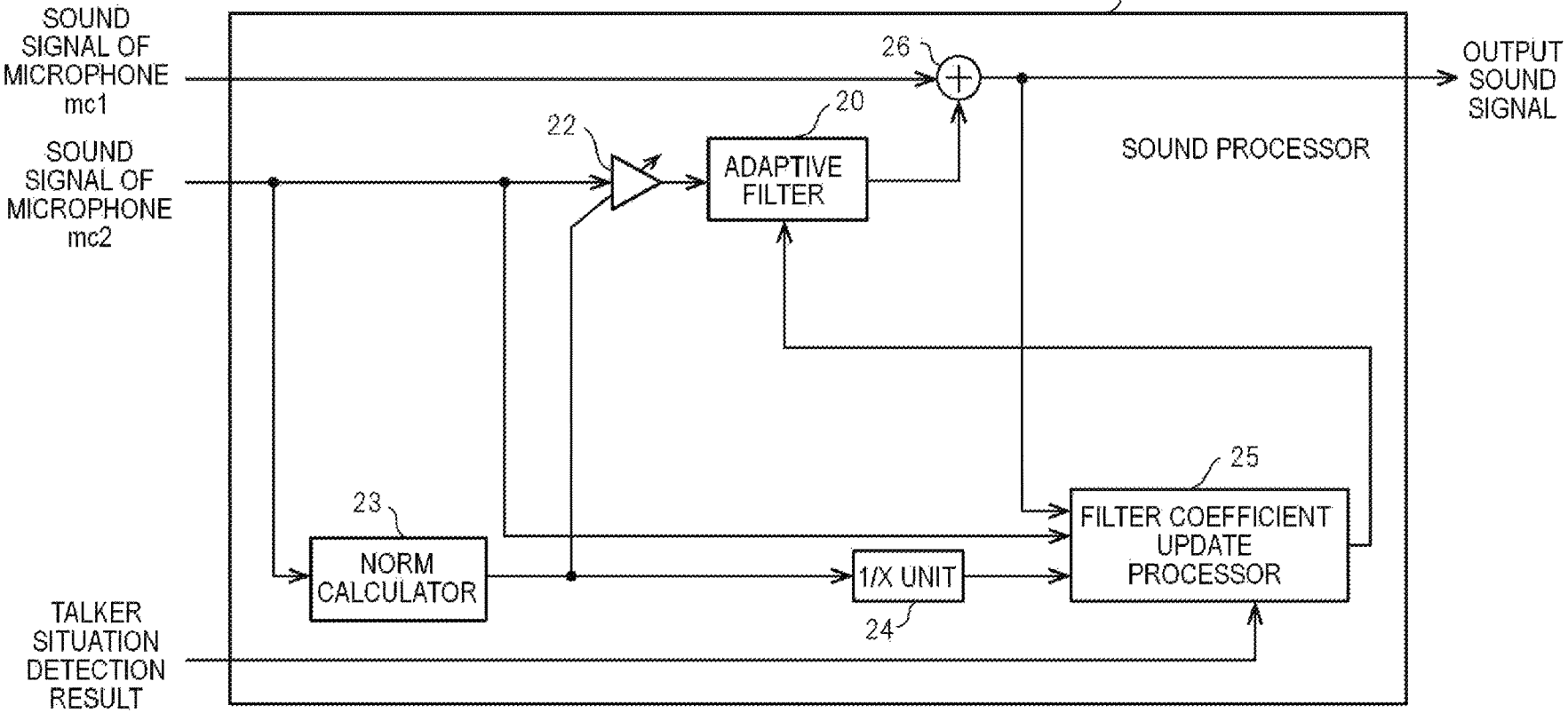
FIG. 3 is a diagram illustrating an example of an inner configuration of a sound processor.

FIG. 3 is a diagram illustrating an inner configuration of the sound processor 12. In a case where, for example, the single talk section is detected as the detection result of the talker situation detected by the talker situation detector 13, the sound processor 12 learns the filter coefficient of the adaptive filter 20 in the single talk section. In addition, the sound processor 12, as an example of a sound output controller, suppresses the crosstalk component included in the sound signal collected by, for example, the microphone mc1, and outputs the sound signal.

For easy understanding of the example of the inner configuration of the sound processor 12, FIG. 3 illustrates a configuration acquired in a case of suppressing the crosstalk component included in the sound signal collected by the microphone mc1. That is, on one input side of an adder 26, the sound signal collected by the microphone mc1 is input as they are. On another input side of the adder 26, a sound signal, which is acquired after the sound signal collected by the microphone mc2 is processed by a variable amplifier 22 and the adaptive filter 20, is input as the crosstalk component. In a case where the crosstalk component included in the sound signal collected by the microphone mc2 is suppressed, the following sound signals are respectively input to the adder 26. Specifically, on one input side of the adder 26, the sound signal collected by the microphone mc2 is input as they are to. On another input side of the adder 26, a sound signal, which is acquired after the sound signal collected by the microphone mc1 is processed by the variable amplifier 22 and the adaptive filter 20, is input as the crosstalk component.

The sound processor 12 includes the adaptive filter 20, the variable amplifier 22, a norm calculator 23, a 1/X unit 24, a filter coefficient update processor 25, and the adder 26.

The norm calculator 23 calculates a norm value indicative of a size of the sound signal from the microphone mc2.

The 1/X unit 24 normalizes a reciprocal number of the norm value calculated by the norm calculator 23 through multiplication, and outputs the normalized norm value to the filter coefficient update processor 25.

The filter coefficient update processor 25, as an example of the parameter updater, updates the filter coefficient of the adaptive filter 20 based on the detection result of the talker situation, the normalized norm value, the sound signal of the microphone mc2, and the output of the adder 26, overwrites and stores the updated filter coefficient (an example of a parameter) in the memory M1, and sets the updated filter coefficient to the adaptive filter 20. For example, the filter coefficient update processor 25 updates the filter coefficient (the example of the parameter) of the adaptive filter 20 in a section, in which the single talk is detected, based on the normalized norm value, the sound signal of the microphone mc2, and the output of the adder 26.

The variable amplifier 22 amplifies the sound signal of the microphone mc2 according to the norm value calculated by the norm calculator 23.

The adaptive filter 20, as an example of the filter, is an FIR filter including a tap, and suppresses the sound signal, which is amplified by the variable amplifier 22, of the microphone mc2 according to the filter coefficient (tap coefficient) as the example of the parameter acquired after the update.

The adder 26 adds the sound signal, which is suppressed by the adaptive filter 20, of the microphone mc2 to the sound signal of the microphone mc1, and outputs an added result. Details of a process performed in the adder 26 will be described later with reference to Equations.

Figure 4:
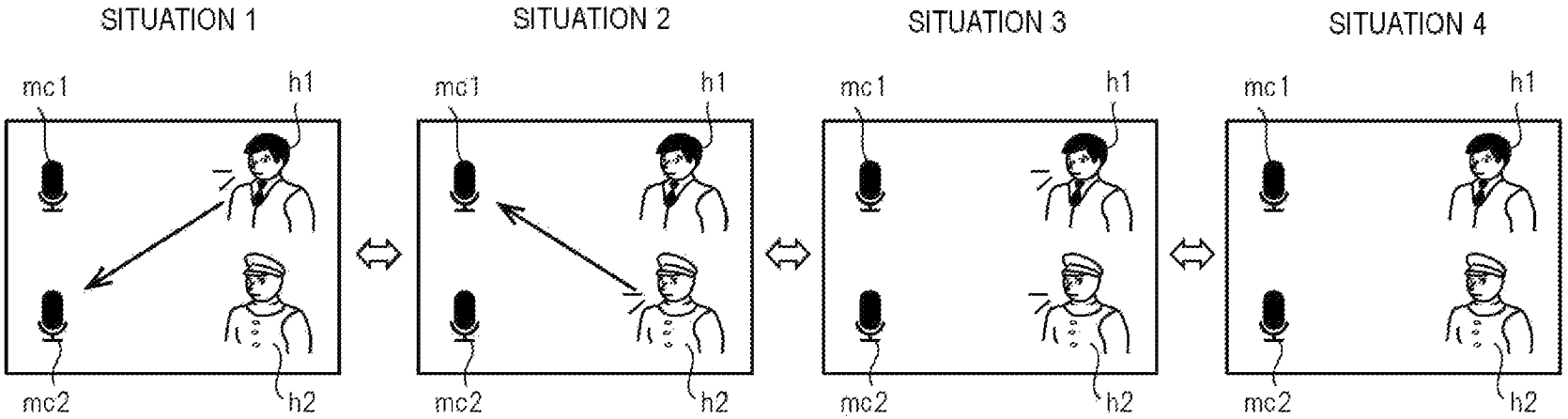
FIG. 4 is a diagram illustrating an example of learning timing of an adaptive filter corresponding to an utterance situation.

FIG. 4 is a diagram illustrating an example of learning timing of the adaptive filter 20 corresponding to the utterance situation. The talker situation detector 13 accurately determines the single talk section, and detects the passenger h1 or the passenger h2 who is talking.

In [situation 1] of the single talk section in which only one passenger h1 who is the talker is talking, the sound processor 12 learns the filter coefficient of the adaptive filter 20 with respect to the microphone mc2 dedicated to the passenger h2.

In addition, in [situation 2] of the single talk section in which only one passenger h2 who is the talker is talking, the sound processor 12 learns the filter coefficient of the adaptive filter 20 with respect to the microphone mc1 dedicated to the passenger h1.

In addition, in [situation 3] in which two persons including the passengers h1 and h2 who are the talkers are simultaneously talking, the sound processor 12 does not learn either the filter coefficient of the adaptive filter 20 with respect to the microphone mc1 dedicated to the passenger h1 who is the talker or the filter coefficient of the adaptive filter 20 with respect to the microphone mc2 dedicated to the passenger h2 who is the talker.

In addition, in [situation 4] in which both two persons including the passengers h1 and h2 are not talking, the sound processor 12 does not learn either the filter coefficient of the adaptive filter 20 with respect to the microphone mc1 dedicated to the passenger h1 or the filter coefficient of the adaptive filter 20 with respect to the microphone mc2 dedicated to the passenger h2.

Subsequently, an operation of the sound processing system 5 according to the first embodiment will be described.

Figure 5:
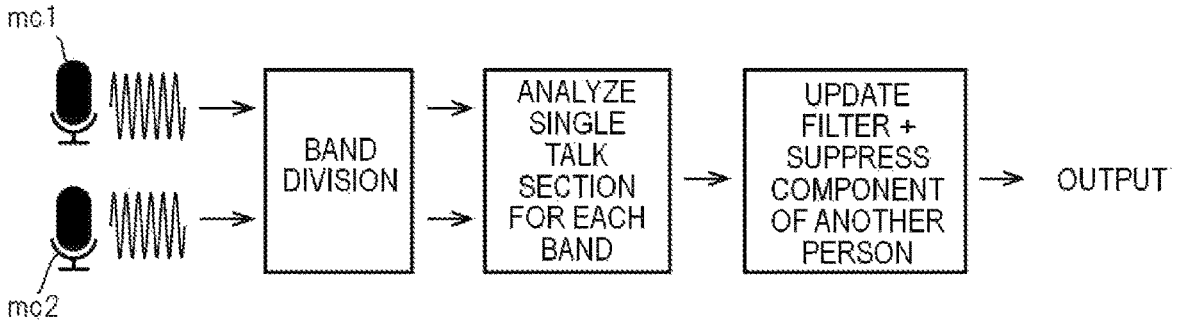
FIG. 5 is a diagram illustrating an example of an overview of an operation of a sound processing apparatus.

FIG. 5 is a diagram illustrating an example of an overview of an operation of the sound processing apparatus 10. The sound signals of the sounds collected by the microphones mc1 and mc2 are input to the sound processing apparatus 10. The band divider 11 performs band division on the sounds collected by the microphones mc1 and mc2. In the band division, division is performed on the sound signals in a sound range of an audible frequency band (30 Hz to 23 kHz), for example, at every band of 500 Hz. Specifically, the sound signals are divided into a sound signal of a band of 0 to 500 Hz, a sound signal of a band of 500 Hz to 1 kHz, a sound signal of a band of 1 kHz to 1.5 kHz, . . . . The talker situation detector 13 detects whether or not the single talk section exists for each band acquired through the division. In the detected single talk section, the sound processor 12 updates, for example, the filter coefficient of the adaptive filter 20 for suppressing the crosstalk component included in the sound signal collected by a microphone dedicated to a passenger other than the talker, and stores an update result in the memory M1. The sound processor 12 suppresses the crosstalk component (in other words, a component of another person) included in the sound signals collected by the microphones mc1 and mc2 using the adaptive filter 20, to which a newest filter coefficient stored in the memory M1 is set, and outputs a sound signal acquired after the suppression. The band combiner 14 combines the sound signals suppressed for each band, and the combined sound signal is output from the sound processing apparatus 10.

Figure 6:
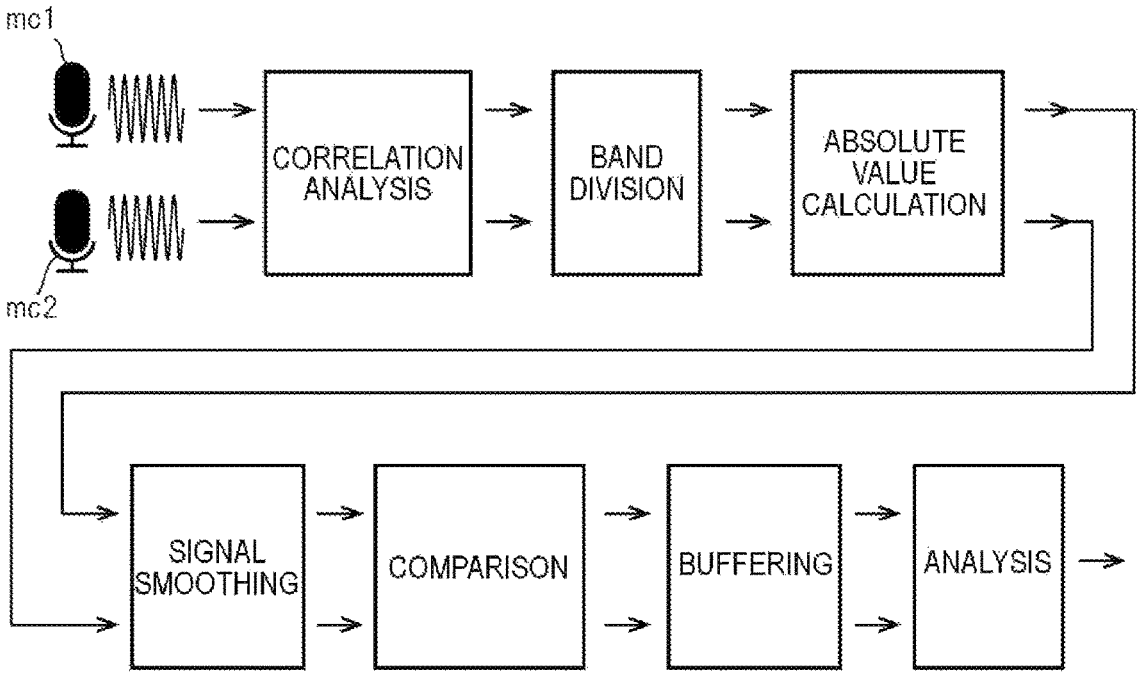
FIG. 6 is a diagram illustrating an example of an overview of a detection operation of a single talk section.

FIG. 6 is a diagram illustrating an example of an overview of a detection operation of the single talk section. In a case where the single talk section is detected, the talker situation detector 13 performs, for example, the following operation. Although FIG. 6 illustrates a case where the talker situation detector 13 performs analysis using a sound signal on a time axis for easy description, the sound signal on the time axis may be converted into a sound signal on a frequency axis, and then the analysis may be performed using the sound signal.

The talker situation detector 13 performs correlation analysis of the sound signals collected by the microphones mc1 and mc2. In a case where a distance between the microphones mc1 and mc2 is short (microphones mc1 and mc2 are near to each other), correlation occurs between the two sound signals. The talker situation detector 13 uses existence/non-existence of the correlation to determine the single talk.

The talker situation detector 13 performs the band division on the two sound signals. The band division is performed using the above-described method. In a case of the narrow space as on the inside of the vehicle, the microphones are easily influenced by reflection of the sounds, and a sound of the specific band is emphasized due to the reflection of the sound. In a case where the band division is performed, it is hardly to be influenced by the reflected sound.

The talker situation detector 13 performs smoothing by calculating absolute values of sound pressure levels of the sound signals collected by the microphones mc1 and mc2 for each band acquired through the division. The talker situation detector 13 detects existence and non-existence of the single talk section by comparing, for example, an absolute value of a past sound pressure level stored in the memory M1 with an absolute value of the smoothed sound pressure level.

The talker situation detector 13 may calculate the absolute values of the sound pressure levels of the sound signals collected by the microphones mc1 and mc2, and may calculate a plurality of smoothed sound pressure levels through the smoothing in a certain section. In a case where a catastrophic sound is generated in a vicinity of one-side microphone, only the smoothed signal on one side become large, and thus it is possible for the talker situation detector 13 to avoid mistakenly determining a sound section of the sound by the talker.

In addition, the talker situation detector 13 may detect the single talk section by estimating a location of the talker. For example, the talker situation detector 13 may estimate a location where the talker exists by comparing the sound signals using sound signals from the past to the current (for example, from a start to an end of the utterance) in addition to current sound signals collected by the microphones mc1 and mc2.

In addition, the talker situation detector 13 may increase accuracy of detection of the single talk by suppressing noises included in the sound signals collected by the microphones mc1 and mc2. In a case where a sound pressure of a noise source is large and an S/N of the sound signal is inferior or in a case where a normal noise source exists in the vicinity of one-side microphone, it is possible for the talker situation detector 13 to estimate the location of the talker by suppressing the noises.

Further, the talker situation detector 13 may detect the single talk by analyzing movement of a mouth of the talker based on an image of an onboard camera (not illustrated in the drawing), without analyzing the sounds or together with the sounds.

Figure 7:
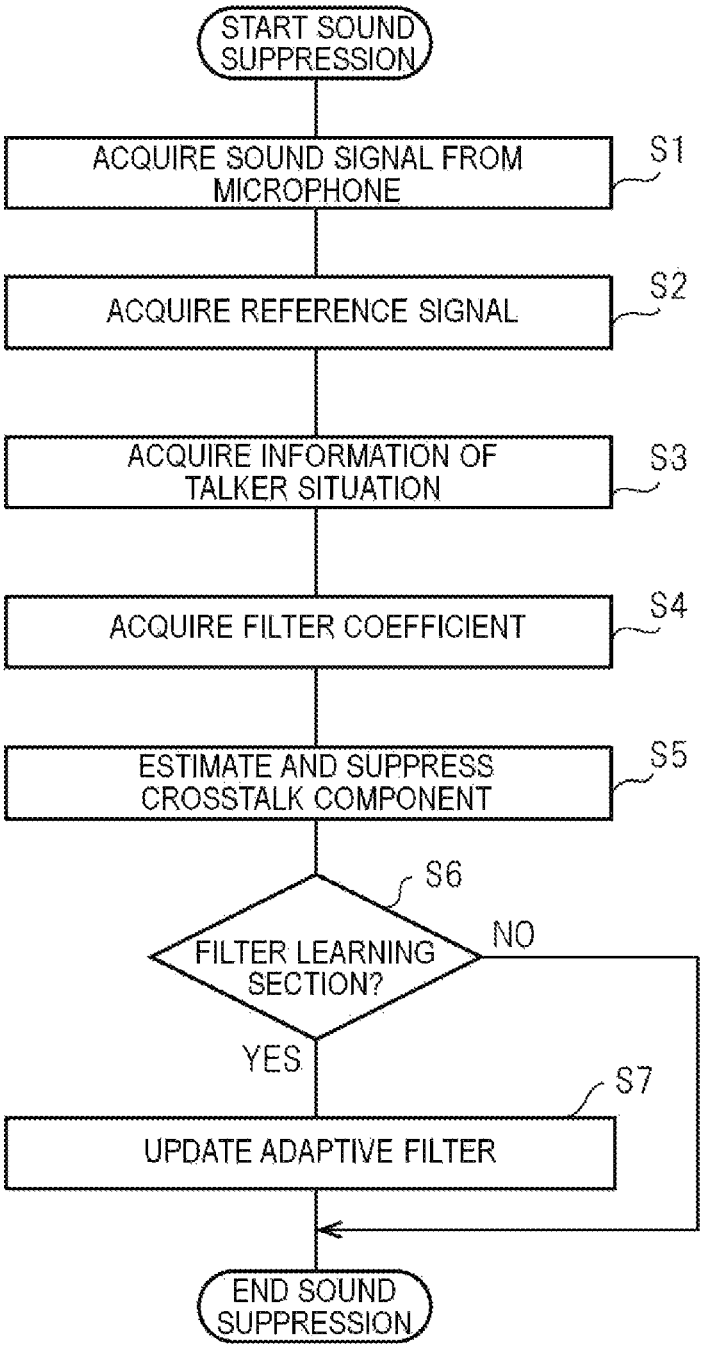
FIG. 7 is a flowchart illustrating an example of a procedure of an operation of a sound suppression process performed by the sound processing apparatus.

FIG. 7 is a flowchart illustrating an example of a procedure of an operation of a sound suppression process performed by the sound processing apparatus 10. The sound processing apparatus 10 is driven in a case where, for example, an ignition switch is turned on, and starts the sound suppression process.

In FIG. 7, the sound processing apparatus 10 acquires the sound signals collected by the microphones mc1 and mc2 (S1). The sound processor 12 acquires, for example, a reference signal which is preserved in the memory M1 for a long time (for example, 100 msec) (S2). The reference signal is a sound signal which is collected by the microphones mc1 and mc2 in a case where the passenger h1 who is the talker is talking toward the microphone mc1, and which is spoken by the passenger h1 who is the talker. For example, in a case where one sample is set to 1 msec as the reference signal for a long time, sound signals corresponding to 100 samples (100 msec) are acquired.

The talker situation detector 13 acquires information of the talker situation (S3). In the talker situation, the talker situation detector 13 analyzes a person who is talking, and detects whether or not the single talk section exists. In the detection of the single talk section, a method for detecting the single talk section, which is described above with reference to FIG. 6, is used. In addition, in a case where the onboard camera (not illustrated in the drawing) is installed on the inside of the vehicle, the talker situation detector 13 may acquire image data of a facial image captured by the onboard camera, and may specify the talker based on the facial image.

Since the talker situation detector 13 grasps a person who is talking in certain time, the sound processor 12 acquires (selects) the filter coefficient of the adaptive filter 20 to be used to correspond to the talker in the certain time (S4). For example, in a case where the passenger h1 who is the talker is talking, the parameter (refer to the above description) of the adaptive filter 20 for suppressing the sound signal of the passenger h1 who is the talker is selected from the sound signal collected by the microphone mc2, and the parameter is used. The sound processor 12 reads the learned newest filter coefficient stored in the memory M1, and sets the newest filter coefficient to the adaptive filter 20. In addition, the sound processor 12 improves a convergence speed of the adaptive filter 20 by overwriting and sequentially updating the filter coefficient stored in the memory M1.

The sound processor 12 estimates the crosstalk component included in the sound signal collected by the microphone mc1 based on a setting table Tb1 (refer to FIG. 8) corresponding to the talker situation, and suppresses the crosstalk component (S5). For example, in a case where the crosstalk component included in the sound signal collected by the microphone mc1 is suppressed, the crosstalk component is suppressed based on the sound signal collected by the microphone mc2 (refer to FIG. 8).

The sound processor 12 determines whether or not a filter learning section of the adaptive filter 20 exists (S6). In the first embodiment, the filter learning section is, for example, the single talk section. The reason for this is that, for example, in a case of the single talk section, one person of the passengers who go on the vehicle 100 substantially becomes the talker and the sound signal based on the utterance of the talker may become the crosstalk component in a case of being viewed from the sound signals collected by the dedicated microphones corresponding to persons other than the talker, and thus it is possible to calculate the filter coefficient which is capable of suppressing the crosstalk component using the sound signals collected by the dedicated microphones corresponding to the persons other than the talker. In the case where the filter learning section exists (S6, YES), the sound processor 12 updates the filter coefficient of the adaptive filter 20, and stores the update result in the memory M1 (S7). Thereafter, the sound processor 12 ends the process. In contrast, in a case where the filter learning section does not exist in step S6 (S6, NO), the sound processor 12 ends the process without updating the filter coefficient of the adaptive filter 20.

FIG. 8 is a diagram illustrating an example of registration content of the setting table Tb1 according to the first embodiment. In the setting table Tb1, for each detection result of the talker situation acquired by the talker situation detector 13, existence/non-existence of update of the filter coefficient, existence/non-existence of a crosstalk suppression process, and equation for acquiring a parameter (for example, the sound pressure) indicative of a size of the sound signal, which is output from the sound processing apparatus 10, are registered in association with each other.

For example, in a case where a fact that the talker does not exist is detected by the talker situation detector 13 as the detection result of the talker situation, the filter coefficient of the adaptive filter 20 is not updated by the filter coefficient update processor 25. In this case, the filter coefficient update processor 25 respectively selects filter coefficients, which are preserved in the memory M1 and correspond to the newest microphones mc1 and mc2 (in other words, the talker), and set to the respective filter coefficients to the adaptive filter 20. Accordingly, the (adder 26 of) sound processor 12 performs the crosstalk suppression process on any of the sound signals collected by the microphones mc1 and mc2 according to Equations (1) and (2). That is, the adder 26 performs a process of subtracting the crosstalk component suppressed using the filter coefficients respectively selected from the sound signals respectively collected by the microphones mc1 and mc2.

$$y1=m1-w21*m2 \tag{1}$$

$$y2=m2-w12*m1 \tag{2}$$

In Equations (1) and (2), m1 is the sound pressure indicative of the size of the sound signal collected by the microphone mc1, m2 is the sound pressure indicative of the size of the sound signal collected by the microphone mc2, y1 is the sound pressure indicative of the size of the sound signal acquired after suppressing the crosstalk component collected by the microphone mc1, and y2 is the sound pressure indicative of the size of the sound signal acquired after suppressing the crosstalk component collected by the microphone mc2. In addition, a coefficient w12 is a filter coefficient for suppressing the crosstalk component based on the utterance of the passenger h1 who is the talker from the sound signal of the microphone mc2 using the microphone mc1, and the coefficient w21 is a filter coefficient for suppressing the crosstalk component based on the utterance of the passenger h2 who is the talker from the sound signal of the microphone mc1 using the microphone mc2. In addition, symbol * indicates an operator indicative of a convolution operation.

Subsequently, for example, in a case where a fact that the talker is the passenger h1 is detected as the detection result of the talker situation which is acquired by the talker situation detector 13 (the single talk section), the filter coefficient with respect to the microphone mc2 of the adaptive filter 20 is updated by the filter coefficient update processor 25. In this case, the filter coefficient update processor 25 selects the newest filter coefficient, which is preserved in the memory M1 and which corresponds to the microphone mc1 (in other words, the talker), and the filter coefficient, which is updated with respect to the sound signal of a previous sample (on the time axis) or a previous frame (on the frequency axis) and which corresponds to the microphone mc2 (in other words, a talker other than the talker), respectively, and sets the filter coefficients to the adaptive filter 20. Accordingly, the (adder 26 of) sound processor 12 performs the crosstalk suppression process on any of the sound signals collected by the microphones mc1 and mc2 according to Equations (1) and (2). That is, the adder 26 performs the process of subtracting the crosstalk component suppressed using the filter coefficients respectively selected from the sound signals respectively collected by the microphones mc1 and mc2. Specifically, since the passenger h1 is the talker, the sound signal based on the utterance of the passenger h1 is collected in the microphone m2 as the crosstalk component and the coefficient w12 is learned and updated such that it is possible to suppress the crosstalk component, compared to the case where the talker does not exist, and thus y2 causes that the sound signal, from which the crosstalk component is sufficiently suppressed, is output based on Equation (2).

Subsequently, for example, in a case where a fact that the talker is the passenger h2 is detected as the detection result of the talker situation which is acquired by the talker situation detector 13 (the single talk section), the filter coefficient is updated with respect to the microphone mc1 of the adaptive filter 20 by the filter coefficient update processor 25. In this case, the filter coefficient update processor 25 selects the newest filter coefficient, which is preserved in the memory M1 and which corresponds to the microphone mc2 (in other words, the talker), and the filter coefficient, which is updated with respect to the sound signal of the previous sample (on the time axis) or the previous frame (on the frequency axis) and which corresponds to the microphone mc1 (in other words, a talker other than the talker), respectively, and sets the filter coefficients to the adaptive filter 20. Accordingly, (the adder 26 of) the sound processor 12 performs the crosstalk suppression process on all the sound signals collected by the microphones mc1 and mc2 according to Equations (1) and (2). That is, the adder 26 performs the process of subtracting the crosstalk component suppressed using the filter coefficients respectively selected from the sound signals respectively collected by the microphones mc1 and mc2. Specifically, since the passenger h2 is the talker, the sound signal based on the utterance of the passenger h2 is collected in the microphone m1 as the crosstalk component and the coefficient w21 is learned and updated such that it is possible to suppress the crosstalk component, compared to the case where the talker does not exist, and thus y1 causes that the sound signal, from which the crosstalk component is sufficiently suppressed, is output based on Equation (1).

Subsequently, for example, in a case where a fact that two talkers including the passengers h1 and h2 exist is detected as the detection result of the talker situation which is acquired by the talker situation detector 13, the filter coefficient of the adaptive filter 20 is not updated by the filter coefficient update processor 25. In this case, the filter coefficient update processor 25 respectively selects the filter coefficients, which are preserved in the memory M1 and correspond to the newest microphones mc1 and mc2 (in other words, the talker), and set to the respective filter coefficients to the adaptive filter 20. Accordingly, (the adder 26 of) the sound processor 12 performs the crosstalk suppression process on any of the sound signals collected by the microphones mc1 and mc2 according to Equations (1) and (2). That is, the adder 26 performs the process of subtracting the crosstalk component suppressed using the filter coefficients respectively selected from the sound signals respectively collected by the microphones mc1 and mc2.

As a use case of the sound processing system 5 according to the first embodiment, for example, a case is assumed where the sound uttered by the driver is recognized and the sound uttered by the passenger who sits on the passenger seat is not recognized as the crosstalk component. Normally, in a case where the crosstalk does not exist, a sound recognition rate is 100% and a false report rate is 0%. In addition, in a case where the crosstalk exists, the sound recognition rate falls to approximately 20%, and the false report rate reaches approximately 90%.

Figure 9:
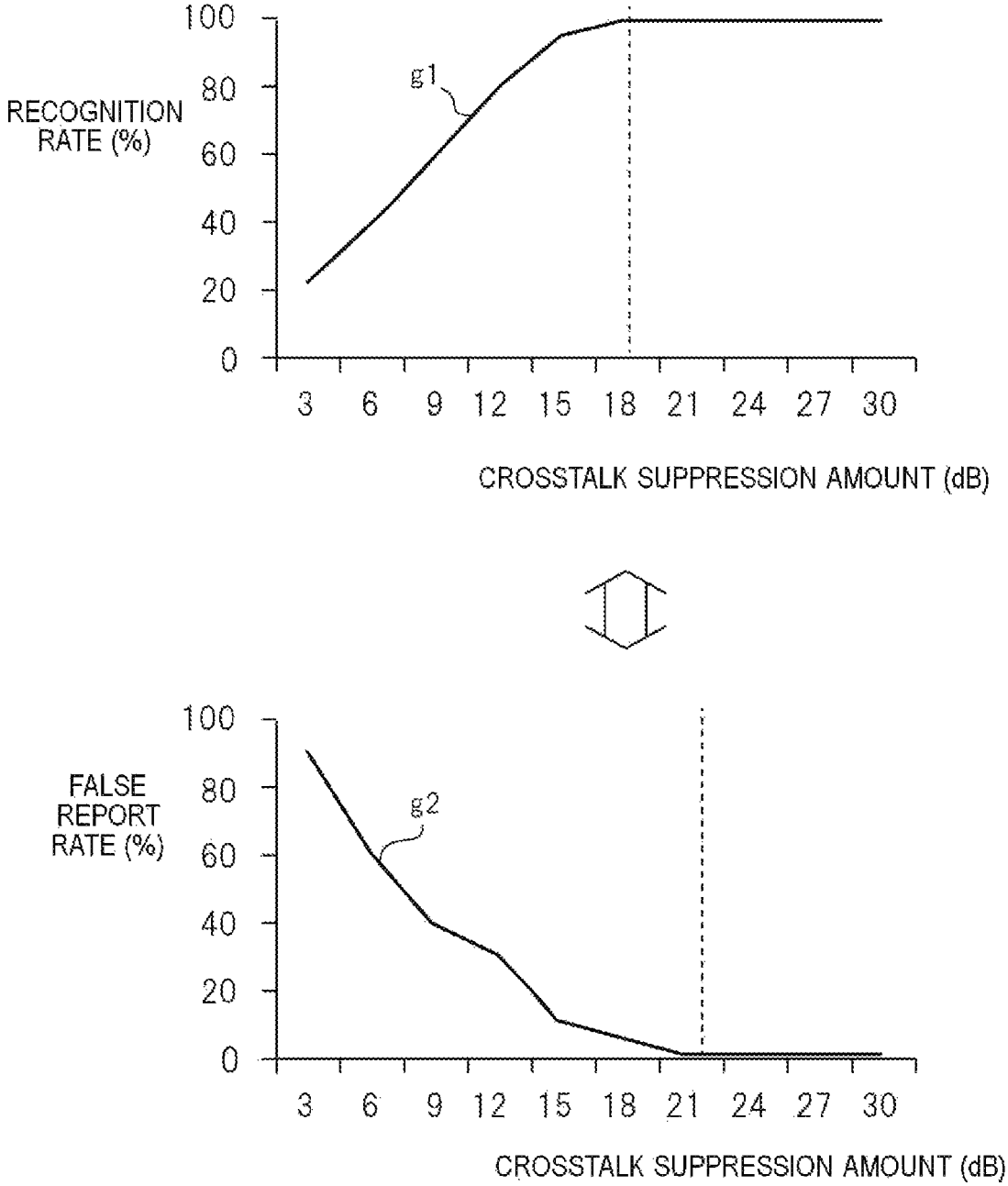
FIG. 9 is a graph illustrating an example of a sound recognition rate and a false report rate with respect to a crosstalk suppression amount.

FIG. 9 is a graph illustrating an example of the sound recognition rate and the false report rate with respect to a crosstalk suppression amount. A graph g1 indicates the sound recognition rate with respect to the crosstalk suppression amount. A vertical axis of the graph indicates the sound recognition rate (%), and a horizontal axis indicates the crosstalk suppression amount (dB). The recognition rate gradually increases together with an increase in the crosstalk suppression amount. For example, in a case where the crosstalk suppression amount is 18 dB, the recognition rate reaches near to 100% and becomes stable.

In addition, a graph g2 indicates the false report rate of the sound with respect to the crosstalk suppression amount. A vertical axis of the graph indicates the false report rate (%) of the sound, and a horizontal axis indicates the crosstalk suppression amount (dB). The false report rate gradually decreases together with the increase in the crosstalk suppression amount. For example, in a case where the crosstalk suppression amount becomes 21 dB, the false report rate falls near to 0% and becomes stable.

In the first embodiment, a case where the sound process is performed on the time axis is described. However, the sound process may be performed on the frequency axis. In a case where the sound process is performed on the frequency axis, the sound processing apparatus 10 performs a frequency analysis by performing Fourier transformation on the sound signal corresponding to one frame (for example, 20 to 30 samples), and acquires the sound signal. In addition, in a case where the sound process is performed on the frequency axis, a process of performing the band division on the sound signal by the band divider 11 is not necessary.

In the sound processing system 5 according to the first embodiment, the crosstalk suppression process is performed on the sound signals, collected by the respective microphones dedicated to the passengers, regardless of the existence/non-existence of the passenger who is talking. Therefore, in a case where a sound of other than the passenger, for example, an idling sound or a stationary sound, such as a noise, is generated, it is possible to suppress the crosstalk component.

As above, the sound processing apparatus 10 according to the first embodiment includes the two microphones mc1 and mc2 which are respectively disposed to face the two passengers h1 and h2 and are dedicated to the respective passengers, the adaptive filter 20 which suppresses the crosstalk component included in the talker sound signal collected by a dedicated microphone corresponding to at least one talker using the sound signals collected by the respective two microphones mc1 and mc2, the filter coefficient update processor 25 which updates the filter coefficient of (the example of the parameter) the adaptive filter 20 for suppressing the crosstalk component and stores the update result in the memory M1 in a case where a predetermined condition including the single talk section (time at which at least one talker talks) is satisfied, and the sound processor 12 which outputs the sound signal, which is acquired by subtracting the crosstalk component suppressed by the adaptive filter 20 based on the update result from the talker sound signal, from the speaker sp1.

Therefore, it is possible for the sound processing apparatus 10 to alleviate influence of the crosstalk component due to the sound uttered by another surrounding passenger under an environment in which the microphone dedicated to each passenger is disposed in the narrow space (enclosed space) such as the vehicle. Accordingly, it is possible for the sound processing apparatus 10 to accurately suppress deterioration in the sound quality of the sound, which is uttered by the talker and is collected by the microphone dedicated to each passenger.

In addition, the sound processing apparatus 10 further includes the talker situation detector 13 which detects the single talk section, in which one talker is substantially talking, for each band using the sound signal collected by each of the two microphones mc1 and mc2. In a case where the single talk section is detected by the talker situation detector 13, the sound processor 12 updates the filter coefficient of the adaptive filter 20 using the sound signal, which is included in the talker sound signal, of a person other than the talker as the crosstalk component while considering that the predetermined condition is satisfied. Therefore, it is possible for the sound processing apparatus 10 to optimize the filter coefficient of the adaptive filter 20 such that it is possible to suppress the talker sound signal based on the utterance of the talker in a case where only one talker substantially exists, as the crosstalk component. For example, it is possible for the sound processing apparatus 10 to highly accurately reduce the crosstalk component included in the sound collected by the microphone dedicated to the talker from a sound collected by a microphone dedicated to the passenger other than the talker.

In addition, in a case where a section other than the single talk section is detected by the talker situation detector 13, the filter coefficient update processor 25 of the sound processor 12 does not update the filter coefficient of the adaptive filter 20 while considering that the predetermined condition is not satisfied. The sound processing apparatus 10 outputs the sound signal acquired by subtracting the crosstalk component, which is suppressed by the adaptive filter 20 based on, for example, the update result of the newest filter coefficient stored in the memory M1, from the talker sound signal. Therefore, in a case where the single talk section does not exist, it is possible for the sound processing apparatus 10 to avoid a case where the filter coefficient is not optimized by omitting the update of the filter coefficient of the adaptive filter 20. In addition, it is possible for another passenger to clearly hear the sound of the talker.

In addition, in a case where the non-utterance section in which nobody talks is detected by the talker situation detector 13, the adaptive filter 20 suppresses the crosstalk component. The sound processor 12 outputs the sound signal acquired by subtracting the crosstalk component, which is suppressed by the adaptive filter 20 based on, for example, the update result of the newest filter coefficient stored in the memory M1, from the sound signal collected by each of the two microphones mc1 and mc2. Therefore, it is possible for the sound processing apparatus 10 to reduce the idling sound, the noise, an echo, or the like.

In addition, in a case where the single talk section is detected by the talker situation detector 13, the adaptive filter 20 suppresses the crosstalk component included in a sound signal, which is collected by the dedicated microphone corresponding to the talker of the single talk section, of other than the talker. The sound processor 12 outputs the sound signal acquired by subtracting the crosstalk component, which is suppressed by the adaptive filter 20 based on, for example, the update result of the newest filter coefficient stored in the memory M1, from the talker sound signal. Therefore, it is possible for the sound processing apparatus 10 to reduce the sound of other than the talker, the idling sound, the noise, or the echo.

Modified Example of First Embodiment

In the first embodiment, the sound processing apparatus 10 normally performs the crosstalk suppression process on the sound signal collected by the dedicated microphone corresponding to the passenger who is talking, regardless of a type of the talker situation (refer to FIG. 8). In a modified example of the first embodiment, an example is described in which the sound processing apparatus 10 does not perform the crosstalk suppression process on the sound signal collected by the dedicated microphone corresponding to the passenger who is talking, for example, in a case where the single talk section is detected. In addition, in a case where the non-utterance section in which nobody talks is detected, the sound processing apparatus 10 does not perform the crosstalk suppression process (refer to FIG. 10).

In the modified example of the first embodiment, an inner configuration of the sound processing system 5 is the same as the inner configuration of the sound processing system 5 according to the first embodiment. Description is simplified or omitted by giving the same symbols to the same configurations, and different content will be described.

FIG. 10 is a diagram illustrating an example of registration content of a setting table Tb2 according to the modified example of the first embodiment. In the setting table Tb2, for each detection result of the talker situation, which is acquired by the talker situation detector 13, existence/non-existence of the update of the filter coefficient, existence/non-existence of the crosstalk suppression process, and Equation for acquiring the parameter (for example, the sound pressure) indicative of the size of the sound signal, which is output from the sound processing apparatus 10, are registered in association with each other.

For example, in a case where a fact that the talker does not exist is detected by the talker situation detector 13 as the detection result of the talker situation, the filter coefficient of the adaptive filter 20 is not updated by the filter coefficient update processor 25. In addition, in the sound processor 12, the crosstalk suppression process is not performed on any of the sound signals collected by the microphones mc1 and mc2 as expressed in Equations (3) and (4). That is, the sound processor 12 outputs all the sound signals collected by the microphones mc1 and mc2 as they are.

$$y1=m1 \tag{3}$$

$$y2=m2 \tag{4}$$

In Equations (3) and (4), m1 is the sound pressure indicative of the size of the sound signal collected by the microphone mc1, m2 is the sound pressure indicative of the size of the sound signal collected by the microphone mc2, y1 is the sound pressure indicative of the size of the sound signal acquired after suppressing the crosstalk component collected by the microphone mc1, and y2 is the sound pressure indicative of the size of the sound signal acquired after suppressing the crosstalk component collected by the microphone mc2.

Subsequently, for example, in a case where a fact that the talker is the passenger h1 is detected as the detection result of the talker situation which is acquired by the talker situation detector 13 (the single talk section), the filter coefficient with respect to the microphone mc2 of the adaptive filter 20 is updated by the filter coefficient update processor 25. In the modified example of the first embodiment, the crosstalk suppression process is not performed on the sound signal (talker sound signal) collected by the microphone mc1 (refer to Equation (5)) in a case where only the passenger h1 is substantially talking. The reason for this is that it is considered that it is difficult that deterioration in the sound quality is generated even in a case where the sound signal (talker sound signal) collected by the microphone mc1 is output as they are while adding a fact that it is difficult that the crosstalk component is generated based on the utterance of the passenger h2 because the passenger h2 is not talking. In contrast, similarly to the first embodiment, the crosstalk suppression process is performed on the sound signal (talker sound signal) collected by the microphone mc2 (refer to Equation (6)).

$$y1=m1 \tag{5}$$

$$y2=m2-w12*m1 \tag{6}$$

In Equation (6), w12 is a filter coefficient for suppressing the crosstalk component based on the utterance of the passenger h1 from the sound signal of the microphone mc2 using the microphone mc1.

Subsequently, for example, in the case where the fact that the talker is the passenger h2 is detected as the detection result of the talker situation which is acquired by the talker situation detector 13 (single talk section), the update of the filter coefficient with respect to the microphone mc2 of the adaptive filter 20 is performed by the filter coefficient update processor 25. However, in the modified example of the first embodiment, similarly, in a case where only the passenger h2 is substantially talking, the crosstalk suppression process is performed on the sound signal (talker sound signal) collected by the microphone mc1 (refer to Equation (7)), similarly to the first embodiment. In contrast, the crosstalk suppression process is not performed on the sound signal (talker sound signal) collected by the microphone mc2 (refer to Equation (8)). The reason for this is that it is considered that it is difficult that deterioration in the sound quality is generated even in a case where the sound signal (talker sound signal) collected by the microphone mc2 is output as they are by adding a fact that it is difficult that the crosstalk component is generated based on the utterance of the passenger h1 because the passenger h1 is not talking.

$$y1=m1-w21*m2 \tag{7}$$

$$y2=m2 \tag{8}$$

In Equation (7), w21 is the filter coefficient for suppressing the crosstalk component based on the utterance of the passenger h2 from the sound signal of the microphone mc1, using the microphone mc2.

Subsequently, for example, in a case where a fact that two talkers including the passengers h1 and h2 exist is detected as the detection result of the talker situation, which is acquired by the talker situation detector 13, the filter coefficient of the adaptive filter 20 is not updated by the filter coefficient update processor 25. In this case, the filter coefficient update processor 25 respectively selects the filter coefficients, which are preserved in the memory M1 and correspond to the newest microphones mc1 and mc2 (in other words, the talker), and set to the respective filter coefficients to the adaptive filter 20. Accordingly, the (adder 26 of) sound processor 12 performs the crosstalk suppression process on all the sound signals collected by the microphones mc1 and mc2 according to Equations (1) and (2), similarly to the first embodiment. That is, the adder 26 performs the process of subtracting the crosstalk component suppressed using the filter coefficients respectively selected from the sound signals respectively collected by the microphones mc1 and mc2.

As above, in the sound processing system 5 according to the modified example of the first embodiment, the crosstalk suppression process is performed on the sound signal collected by the microphone dedicated to the passenger who is not talking in a case where at least one person is talking (refer to FIG. 10). Accordingly, in the microphone dedicated to the passenger who is not talking, the sound signal of the passenger who is talking is suppressed, thereby being an almost soundless state. In contrast, in the dedicated microphone corresponding to the passenger who is talking, the crosstalk suppression process is not performed because another passenger is not talking. As above, it is possible for the sound processing system 5 to perform the crosstalk suppression process only in a necessary case.

In addition, the adaptive filter 20 does not suppress the crosstalk component in a case where the non-utterance section in which nobody talks is detected. The sound processing apparatus 10 outputs the sound signal collected by each of the two microphones mc1 and mc2 as they are. In this manner, the sound processing apparatus 10 does not suppress the crosstalk component in the non-utterance section, and thus the sound signal collected by the microphone becomes clear.

In addition, in a case where the single talk section is detected, the adaptive filter 20 does not suppress the crosstalk component included in the talker sound signal. The sound processing apparatus 10 outputs the sound signal collected by the dedicated microphone corresponding to the talker as they are. In the single talk section, a sound signal based on an utterance by a person other than the talker does not exist, and thus the talker sound signal becomes clear even in a case where the crosstalk component is not suppressed.

Second Embodiment

In the first embodiment, in a case where the single talk section is detected, the sound processor 12 updates the filter coefficient associated with the dedicated microphone corresponding to the talker. In a second embodiment, an example will be described in which the sound processor 12 updates the filter even in a case where, for example, two talkers are simultaneously talking (double talk section) while being not limited to the case where the single talk section is detected.

Figure 11:
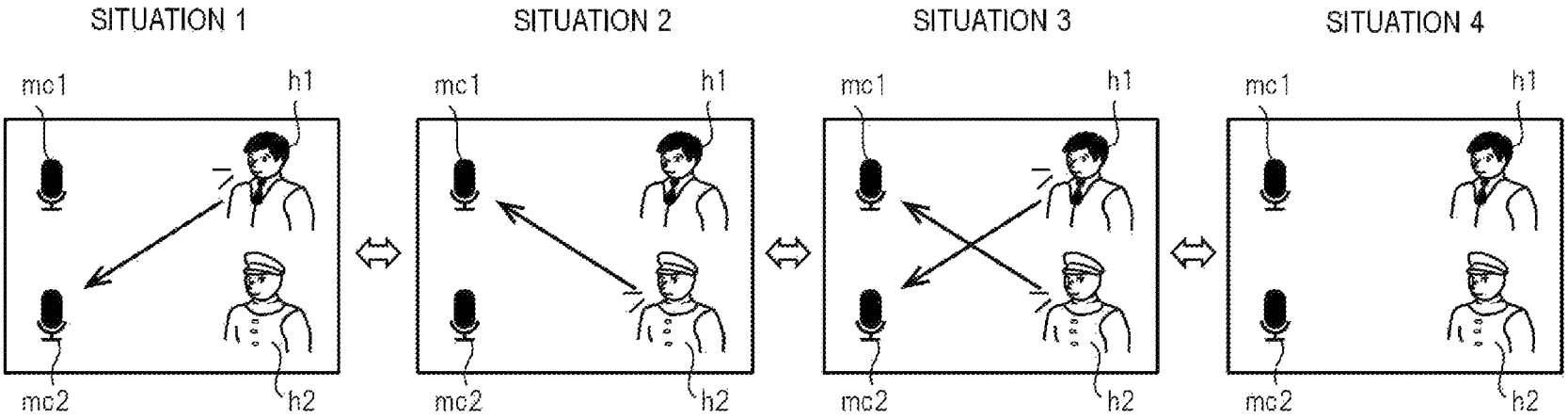
FIG. 11 is a diagram illustrating an example of learning timing of an adaptive filter corresponding to an utterance situation according to a second embodiment.

FIG. 11 is a diagram illustrating an example of learning timing of the adaptive filter 20 corresponding to an utterance situation according to the second embodiment. The talker situation detector 13 accurately determines the single talk section, and detects whether or not the passenger h1 and the passenger h2 are talking.

In [situation 1] of the single talk section in which only the passenger h1 who is one talker is talking, the sound processor 12 learns the filter coefficient of the adaptive filter 20 with respect to the microphone mc2 dedicated to the passenger h2.

In addition, in [situation 2] of the single talk section in which only one passenger h2 who is the talker is talking, the sound processor 12 learns the filter coefficient of the adaptive filter 20 with respect to the microphone mc1 dedicated to the passenger h1.

In addition, in [situation 3] of the double talk section in which two persons including the passengers h1 and h2 who are the talkers are simultaneously talking, the sound processor 12 learns any of the filter coefficient of the adaptive filter 20 with respect to the microphone mc1 dedicated to the passenger h1 who is the talker and the filter coefficient of the adaptive filter 20 with respect to the microphone mc2 dedicated to the passenger h2 who is the talker.

In addition, in [situation 4] in which both the two persons including the passengers h1 and h2 is not talking, the sound processor 12 does not learn either the filter coefficient of the adaptive filter 20 with respect to the microphone mc1 dedicated to the passenger h1 or the filter coefficient of the adaptive filter 20 with respect to the microphone mc2 dedicated to the passenger h2.

In addition, in a case where the talker situation detector 13 detects a situation (double talk), in which two talkers are simultaneously talking, in addition to the single talk, the talker situation detector 13 notifies a detection result to the sound processor 12. The sound processor 12 learns the filter coefficient of the adaptive filter 20, which is associated with the microphone corresponding to the talker, in each of the single talk section and the double talk section.

In the second embodiment, an inner configuration of the sound processing system 5 is the same as the inner configuration of the sound processing system 5 according to the first embodiment. Description is simplified or omitted by giving the same symbols to the same configurations, and different content will be described.

FIG. 12 is a diagram illustrating an example of registration content of a setting table Tb3 according to the second embodiment. In the setting table Tb3, for each detection result of the talker situation, which is acquired by the talker situation detector 13, existence/non-existence of the update of the filter coefficient, existence/non-existence of the crosstalk suppression process, and Equation for acquiring the parameter (for example, the sound pressure) indicative of the size of the sound signal, which is output from the sound processing apparatus 10, are registered in association with each other.

For example, in a case where a fact that the talker does not exist is detected by the talker situation detector 13 as the detection result of the talker situation, the filter coefficient of the adaptive filter 20 is not updated by the filter coefficient update processor 25. In this case, the filter coefficient update processor 25 respectively selects the filter coefficients, which are preserved in the memory M1 and correspond to the newest microphones mc1 and mc2 (in other words, the talker), and set to the respective filter coefficients to the adaptive filter 20. Accordingly, similar to the modified example of the first embodiment, the crosstalk suppression process is not performed on any of the sound signals collected by the microphones mc1 and mc2 according to Equations (3) and (4) in the sound processor 12. That is, the sound processor 12 outputs all the sound signals collected by the microphones mc1 and mc2 as they are.

Subsequently, for example, in a case where a fact that the talker is the passenger h1 (referred to as a "situation A" in description with reference to FIG. 12) is detected as the detection result of the talker situation which is acquired by the talker situation detector 13 (single talk section), the filter coefficient with respect to the microphone mc2 of the adaptive filter 20 is updated by the filter coefficient update processor 25. In this case, the filter coefficient update processor 25 selects the newest filter coefficient, which is preserved in the memory M1 and which corresponds to the microphone mc1 (in other words, the talker), and the filter coefficient, which is updated with respect to the sound signal of a previous sample (on the time axis) or a previous frame (on the frequency axis) and which corresponds to the microphone mc2 (in other words, a talker other than the talker), respectively, and sets the filter coefficients to the adaptive filter 20. Accordingly, the (adder 26) of the sound processor 12 performs the crosstalk suppression process on any of the sound signals collected by the microphones mc1 and mc2 according to Equations (9) and (10).

$$y1=m1-w21A*m2 \tag{9}$$

$$y2=m2-w12A*m1 \tag{10}$$

In Equations (9) and (10), the coefficient w12A is a filter coefficient for suppressing the crosstalk component based on the utterance of the passenger h1 who is the talker from the sound signal of the microphone mc2 using the microphone mc1 in the situation A. Similarly, the coefficient w21A is a filter coefficient for suppressing the crosstalk component based on the utterance of the passenger h2 who is the talker from the sound signal of the microphone mc1 using the microphone mc2 in the situation A.

That is, the adder 26 performs the process of subtracting the crosstalk component, which is suppressed using the filter coefficients respectively selected according to the talker situation (that is, the "situation A") detected by the talker situation detector 13, from the sound signals respectively collected by the microphones mc1 and mc2. Specifically, since the passenger h1 is the talker, the sound signal based on the utterance of the passenger h1 is collected as the crosstalk component in the microphone m2. Further, since the coefficient w12A is learned and updated such that it is possible to suppress the crosstalk component compared to a case where the no talker exists, y2 is output as the sound signal, from which the crosstalk component is sufficiently suppressed, based on Equation (10).

Subsequently, for example, in the case where the fact that the talker is the passenger h2 (referred to as a "situation B" in description with reference to FIG. 12) is detected as the detection result of the talker situation which is acquired by the talker situation detector 13 (single talk section), the filter coefficient is updated with respect to the microphone mc1 of the adaptive filter 20 by the filter coefficient update processor 25. In this case, the filter coefficient update processor 25 selects the newest filter coefficient, which is preserved in the memory M1 and which corresponds to the microphone mc2 (in other words, the talker), and the filter coefficient, which is updated with respect to the sound signal of the previous sample (on the time axis) or the previous frame (on the frequency axis) and which corresponds to the microphone mc1 (in other words, a talker other than the talker), respectively, and sets the filter coefficients to the adaptive filter 20. Accordingly, the (adder 26 of the) sound processor 12 performs the crosstalk suppression process on any of the sound signals collected by the microphones mc1 and mc2 according to Equations (11) and (12).

$$y1=m1-w21B*m2 \tag{11}$$

$$y2=m2-w12B*m1 \tag{12}$$

In Equations (11) and (12), a coefficient w12B is a filter coefficient for suppressing the crosstalk component based on the utterance of the passenger h1 who is the talker from the sound signal of the microphone mc2 using the microphone mc1 in the situation B. Similarly, a coefficient w21B is a filter coefficient for suppressing the crosstalk component based on the utterance of the passenger h2 who is the talker from the sound signal of the microphone mc1 using the microphone mc2 in the situation B.

That is, the adder 26 performs a process of subtracting the crosstalk component, which is suppressed using the filter coefficients respectively selected according to the talker situation (that is, a "situation B") detected by the talker situation detector 13, from the sound signals respectively collected by the microphones mc1 and mc2. Specifically, since the passenger h2 is the talker, the sound signal based on the utterance of the passenger h2 is collected as the crosstalk component in the microphone m1. Further, since the coefficient w12B is learned and updated such that it is possible to suppress the crosstalk component compared to a case where the no talker exists, y2 is output as the sound signal, from which the crosstalk component is sufficiently suppressed, based on Equation (12).

Subsequently, for example, in a case where a fact that the talker includes two persons including the passengers h1 and h2 (referred to as a "situation C" in description with reference to FIG. 12) is detected as the detection result of the talker situation which is acquired by the talker situation detector 13 (double talk section), the filter coefficients of the adaptive filter 20, which are respectively associated with the microphones mc1 and mc2, are separately updated by the filter coefficient update processor 25. In this case, the filter coefficient update processor 25 respectively selects the filter coefficients, which are preserved in the memory M1 and which correspond to the microphones mc1 and mc2 updated with respect to the sound signal of the previous sample (on the time axis) or the previous frame (on the frequency axis), and sets the filter coefficients to the adaptive filter 20. Accordingly, the (adder 26) of the sound processor 12 performs the crosstalk suppression process on any of the sound signals collected by the microphones mc1 and mc2 according to Equations (13) and (14).

$$y1=m1-w21C*m2 \tag{13}$$

$$y2=m2-w12C*m1 \tag{14}$$

In Equations (13) and (14), the coefficient w12C is the filter coefficient for suppressing the crosstalk component based on the utterance of the passenger h1 who is the talker from the sound signal of the microphone mc2 using the microphone mc1 in the situation C. Similarly, the coefficient w21C is the filter coefficient for suppressing the crosstalk component based on the utterance of the passenger h2 who is the talker from the sound signal of the microphone mc1 using the microphone mc2 in the situation C.

That is, the adder 26 performs a process of subtracting the crosstalk component, which is suppressed using the filter coefficients respectively selected according to the talker situation (that is, the "situation C") detected by the talker situation detector 13, from the sound signals respectively collected by the microphones mc1 and mc2. Specifically, since both the passengers h1 and h2 are the talkers, the sound signals based on the utterance of passengers h1 and h2 are collected as the crosstalk components in the microphones m1 and m2. Further, since the coefficients w21C and w12C are learned and updated such that it is possible to suppress the crosstalk components compared to a case where the no talker exists, y1 and y2 are output as the sound signals, from which the crosstalk components are sufficiently suppressed, based on Equations (13) and (14).

As above, in the second embodiment, in a case where two talkers are simultaneously talking, the sound of another talker is input to one-side microphone and the crosstalk easily occurs. Further, a sound echo occurs due to the sound output from the speaker. In a case where the filter coefficient of the adaptive filter 20 corresponding to the dedicated microphone corresponding to each talker is learned, the sound processing apparatus 10 is capable of not only suppressing the crosstalk component but also reducing the sound echo. Accordingly, the sound processing apparatus 10 functions as a sound echo suppression apparatus (howling canceller).

As above, the sound processing apparatus 10 according to the second embodiment further includes the talker situation detector 13 which determines the talker situation indicative of existence/non-existence of utterances of the two passengers. In a case where it is determined that at least one talker exists, the sound processor 12 updates the filter coefficient corresponding to the microphone dedicated to the passenger other than the talker while using the talker sound signal, which is collected by the microphone dedicated to the passenger other than the talker, as the crosstalk component, and stores the update result as a filter coefficient dedicated to the talker.

From this, the sound processing apparatus 10 learns the filter coefficient corresponding to the microphone dedicated to each talker. Therefore, in a case where another passenger is also talking, it is possible to suppress a crosstalk component, which is included in the sound signal collected by the microphone dedicated to the talker, due to another passenger. In addition, the sound output from the speaker is not collected by the microphone dedicated to the talker, and thus it is possible for the sound processing apparatus 10 to reduce the sound echo.

Hereinabove, although various embodiments are described with reference to the accompanying drawings, needless to say, the present disclosure is not limited to the examples. It is clear that those skilled in the art can easily expect various changed examples, modified examples, replacement examples, added examples in the categories written in the claims, removal examples, and equivalent examples, and it is understood that those examples naturally belong to a technical scope of the present disclosure. In addition, the respective components in the above-described various embodiments may be randomly combined in the scope without departing from the gist of the present invention.

For example, the single talk section may not be limited to a section in which only one passenger is talking, and a section, which is considered that only one passenger is substantially talking, may be used as the single talk section even in a talker situation in which a plurality of persons are talking. The reason for this is that, for example, even in a case where a man who talks a sound at a low frequency and a woman who talks a sound at a high frequency are talking together, it is possible for the talker situation detector 13 to perform division on respective sound signals to the extent that repetition (interference) of the frequency band is not generated, and thus it is possible to consider as the single talk section.

For example, in the embodiments, the band division is performed in a sound range of an audible frequency band (30 Hz to 23 kHz) by a bandwidth of 500 Hz, to provide 0 to 500 Hz, 500 Hz to 1 kHz, . . . . However, the band division may be performed by a random bandwidth, such as a bandwidth of 100 Hz, a bandwidth of 200 Hz, or a bandwidth of 1 kHz. In addition, in the embodiments, the bandwidth is fixedly set. However, the bandwidth may be dynamically and variably set according to a situation in which the talker exists. For example, in a case where only the aged go on board or gather, it is generally considered that the aged only hear a sound in a low sound range and perform a conversation in a sound range, which is equal to or lower than 10 kHz, in many cases. In this case, the band division may be narrowly performed on a sound range which is equal to or lower than 10 kHz by, for example, a bandwidth of 50 Hz, and may be widely performed on a sound range which is higher than 10 kHz by, for example, a bandwidth of 1 kHz. In addition, since children and women hear a sound in a high sound range, a sound close to 20 kHz becomes the crosstalk component. In this case, the band division may be narrowly performed on the sound range which is higher than 10 kHz by, for example, a bandwidth of 100 Hz.

In addition, in the above embodiments, a case where the conversation is performed on the inside of the vehicle is assumed. However, the present disclosure may be similarly applied to a case where a plurality of persons perform the conversation in a conference room in a building. In addition, it is possible to apply the present disclosure to a case where the conversation is performed in a teleconference system or a case where captions (telop) of a TV are played.

The present disclosure is available as a sound processing apparatus and a sound processing method, which alleviate influence of a crosstalk component based on a sound uttered by another surrounding person, and which suppress deterioration in a sound quality of a sound that is uttered by a talker and is collected by a relevant microphone, under an environment in which different microphones are disposed to correspond to respective persons.

What is claimed is:

1. A sound processing apparatus comprising:

a memory that stores n number of parameters of a filter respectively corresponding to n number of microphones disposed correspondingly to n number of persons in one enclosed space, where n is an integer which is equal to or larger than 2, a sound output controller that receives respective talker sound signals collected by the n number of microphones, and outputs respective sound signals corresponding to the n number of microphones, the sound output controller including:

the filter, configured to suppress respective crosstalk components generated due to an utterance of another talker, the crosstalk components being included in the respective talker sound signals collected by the n number of microphones, and a first processor configured to perform a learning process to update a parameter of the filter for suppressing the crosstalk components and to overwrite the updated parameter in the memory; and a second processor configured to detect an utterance situation of each of the n number of persons, to which the n number of microphones correspond, in the enclosed space by using the respective talker sound signals collected by the n number of microphones, the second processor detecting, as the utterance situation, a single talk section in which a single talker is substantially talking in the enclosed space, wherein the first processor performs the learning process to update the parameter of the filter for suppressing the crosstalk components and overwrites the updated parameter in the memory, in a case where the second processor detects the single talk section, wherein the first processor does not perform the learning process to update the parameter of the filter, in a case where the second processor does not detect the single talk section, wherein the sound output controller reads a parameter stored in the memory and the filter suppresses the crosstalk components included in the talker sound signals collected by a microphone of the n number of microphones using the read parameter without updating the parameter, in the case where the second processor does not detect the single talk section, wherein the filter suppresses the crosstalk components included in the talker sound signals collected by a microphone of the n number of microphones not corresponding to the single talker who talks in the enclosed space, using the updated parameter, in the case where the second processor detects the single talk section, wherein the sound output controller outputs as the respective sound signals, one of a first sound signal and a second sound signal, selected based on a result of the detection of the single talk section determined by the second processor, the first sound signal being acquired by suppressing the crosstalk components of the talker sound signals by the filter for the received talker sound signals, and the second sound signal being the received talker sound signals without suppressing the crosstalk components by the filter.

2. The sound processing apparatus according to claim 1, wherein the filter suppresses the crosstalk components generated due to an utterance of another person with respect to the respective talker sound signals collected by the n number of microphones corresponding to the n number of persons in a case where the second processor determines that all the n number of persons are talking.

3. The sound processing apparatus according to claim 1, wherein the second processor detects the utterance situation in the enclosed space by performing correlation analysis on the respective talker sound signals collected by the n number of microphones.

4. The sound processing apparatus according to claim 3, wherein the second processor performs the correlation analysis using a value acquired by calculating and smoothing absolute values of sound pressure levels of the respective talker sound signals collected by the n number of microphones.

5. The sound processing apparatus according to claim wherein the second processor further detects, as the utterance situation, a section other than the single talk section in the closed space, the first processor does not perform the learning process to update the parameter of the filter, in a case where the second processor detects the section other than the single talk section, and the sound output controller determines that a crosstalk suppression process is performed on the talker sound signals collected by each microphone corresponding to a talker who is determined to be substantially talking in the detected section other than the single talk section, and outputs the first sound signal which is acquired by suppressing the crosstalk components by the filter based on the parameter read from the memory from the talker sound signals collected by each microphone corresponding to the talker who is determined to be substantially talking.

6. The sound processing apparatus according to claim 1, wherein the second processor further detects, as the utterance situation, a non-utterance section, in which nobody talks in the enclosed space, and in a case where the second processor detects the non-utterance section, the first processor does not perform the learning process to update the parameter of the filter, the sound output controller determines that a crosstalk suppression process is not performed on the taker sound signals collected by each of the n-number of microphones, and outputs the second sound signal collected by each of the n number of microphones as it is.

7. The sound processing apparatus according to claim 1, wherein, in a case where the second processor determines that the at least one talker exists in the enclosed space, the first processor updates the parameter of the filter using the talker sound signals collected by the microphones corresponding to the persons other than the talker as the crosstalk components, and stores an update result as a parameter corresponding to the talker.

8. The sound processing apparatus according to claim 1, wherein the second processor further detects, as the utterance situation, a non-utterance section, in which nobody talks in the enclosed space, and in a case where the second processor detects the non-utterance section, the first processor does not perform the learning process to update the parameter of the filter, the sound output controller determines that a crosstalk suppression process is performed on the talker sound signals collected by each of the n-number of microphones, and outputs the first sound signal acquired by suppressing the crosstalk components by the filter based on the parameter read from the memory from the talker sound signals collected by each of the n number of microphones.

9. The sound processing apparatus according to claim 1, wherein in a case where the second processor detects the single talk section, the first processor performs the learning process to update the parameter corresponding to a microphone disposed correspondingly to a person other than the single talker in the detected single talk section, and overwrites the updated parameter in the memory.

10. The sound processing apparatus according to claim 9, wherein in a case where the second processor detects the single talk section, the sound output controller determines that a crosstalk suppression process is not performed on the talker sound signals collected by the microphone corresponding to the single talker in the detected single talk section, and outputs the second sound signal including the talker sound signals collected by the microphone corresponding to the single talker without performing the crosstalk suppression process, and the sound output controller determines that the crosstalk suppression process is performed on the taker sound signals collected by the microphone corresponding to a person other than the single talker, and outputs the first sound signal in which a sound of the single talker is suppressed from the talker sound signals collected by the microphone corresponding to the person other than the single talker using the updated parameter by the first processor.

11. The sound processing apparatus according to claim 9, wherein in a case where the second processor detects the single talk section, the sound output controller determines that a crosstalk suppression process is performed on the talker sound signals collected by the microphone corresponding to the single talker in the detected single talk section, and outputs the first sound signal in which a sound of a person other than the single talker is suppressed from the talker sound signals collected by the microphone corresponding to the single talker using the parameter read from the memory, and the sound output controller determines that the crosstalk suppression process is performed on the taker sound signals collected by the microphone corresponding to the person other than the single talker, and outputs the first sound signal in which a sound of the single talker is suppressed from the talker sound signals collected by the microphone corresponding to the person other than the single talker using the parameter updated by the first processor.

12. The sound processing apparatus according to claim 1, wherein the memory stores a table including a plurality of utterance situations, each being associated with a microphone corresponding to a parameter of the filter to be updated, and existence or non-existence of a crosstalk suppression process for each of the n-number microphones, the plurality of utterance situations including at least the single talk section, a non-utterance section in which no one talks, and a section in which at least two talkers talk, when the second processor detects the single talk section, the first processor determines a microphone corresponding to a parameter to be updated with reference to the table, and performs the learning process to update the parameter corresponding to the determined microphone, and the sound output controller determines, with reference to the table, whether or not the crosstalk suppression process is performed on the talker sound signals collected by each of the n number of microphones, and outputs the first sound signal form the microphone that is determined that the crosstalk suppression process is performed with reference to the table, and outputs the second sound signal for the microphone that is determined that the crosstalk suppression process is not performed with reference to the table.

13. A sound processing method comprising:

receiving respective talker sound signals collected by n number of microphones disposed correspondingly to n number of persons in one enclosed space, where n is an integer which is equal to or larger than 2;

suppressing, by a filter with reference to a memory, respective crosstalk components generated due to an utterance of another talker, the crosstalk components being included in respective talker sound signals collected by the n number of microphones, the memory storing n number of parameters of the filter respectively corresponding to the n number of microphones;

detecting an utterance situation of each of the n number of persons, to which the n number of microphones correspond, in the enclosed space by using the respective talker sound signals collected by the n number of microphones, the utterance situation including a single talk section in which a single talker is substantially talking in the enclosed space;

performing a learning process to update a parameter of the filter for suppressing the crosstalk components and overwriting the updated parameter in the memory, in a case where the single talk section is detected; and not performing the learning process to update the n number of parameters of the filter, in a case where the single talk section is not detected, wherein the suppressing reads a parameter stored in the memory and suppresses the crosstalk components included in the talker sound signals collected by a microphone of the n number of microphones using the read parameter without updating the parameter, in the case where the single talk section is not detected, and wherein the suppressing suppresses crosstalk components included in the talker sound signals collected by a microphone of the n number of microphones not corresponding to the single talker who talks in the enclosed space, using the updated parameter, in the case where the single talk section is detected, outputting one of a first sound signal and a second sound signal, as an output signal of each of the n number of microphones selected based on a result of the detection of the single talk section, the first sound signal being acquired by suppressing the crosstalk components of the talker sound signals by the filter for the received talker sound signals, and the second sound signal being the received talker sound signals without suppressing the crosstalk components by the filter.

* * * * *